US009573006B2

(12) United States Patent
Hansen

(10) Patent No.: US 9,573,006 B2
(45) Date of Patent: Feb. 21, 2017

(54) FIRE EXTINGUISHING ASSEMBLY FOR TRANSFORMING A LIQUID TO A LIQUID MIST

(75) Inventor: Bjørn Rafael Hansen, Lillehammer (NO)

(73) Assignee: Prevent Systems AS, Lillehammer (NO)

( * ) Notice: Subject to any disclaimer, the term of this patent is extended or adjusted under 35 U.S.C. 154(b) by 359 days.

(21) Appl. No.: 13/514,405

(22) PCT Filed: Dec. 14, 2010

(86) PCT No.: PCT/NO2010/000457

§ 371 (c)(1),
(2), (4) Date: Jul. 19, 2012

(87) PCT Pub. No.: WO2011/074979

PCT Pub. Date: Jun. 23, 2011

(65) Prior Publication Data

US 2012/0279730 A1 Nov. 8, 2012

(30) Foreign Application Priority Data

Dec. 14, 2009 (NO) ..... 20093514

(51) Int. Cl.
*A62C 37/11* (2006.01)
*A62C 37/14* (2006.01)
(Continued)

(52) U.S. Cl.
CPC ..... *A62C 31/05* (2013.01); *A62C 99/0072* (2013.01); *A62C 31/02* (2013.01); *A62C 37/00* (2013.01);
(Continued)

(58) Field of Classification Search
CPC ..... A62C 37/00; A62C 37/08; A62C 37/11; A62C 37/14; A62C 31/02
(Continued)

(56) References Cited

U.S. PATENT DOCUMENTS 6,726,119 B2 * 4/2004 Fischer ..... A62C 37/14 239/37
6,976,544 B2 * 12/2005 Sundholm ..... 169/42
(Continued)

FOREIGN PATENT DOCUMENTS

DE 102008021925 * 11/2009 ..... A62C 31/05
WO WO2006043738 * 4/2006 ..... A62C 31/02
WO WO-2009/132867 11/2009

OTHER PUBLICATIONS

Machine Translation of DE 102008021925 A1, Nov. 2009, Germany, Lakkonen, Max.*
(Continued)

*Primary Examiner* — Darren W Gorman
*Assistant Examiner* — Christopher R Dandridge
(74) *Attorney, Agent, or Firm* — Foley & Lardner LLP

(57) ABSTRACT

The present invention relates to a fire extinguishing assembly for transforming a liquid into a liquid mist. The assembly includes an adapter section (3*a*, 14*a*) having at least one liquid inlet (3*b*, 14*b*) and a nipple section (6*a*, 9*a*) that connects to the adapter section. The nipple section includes a plurality of bores (6*c*, 9*c*) extending between an internal duct (12*g*) that connects to the liquid inlet (3*b*, 14*b*), and outlets on an outside of the nipple section (6*a*, 9*a*). The bores (6*c*, 9*c*) are located around the nipple section (6*a*, 9*a*). A deflecting surface (3*d*, 12*d*) for guiding the liquid is positioned around the outlets of the bores (6*c*, 9*c*). The deflecting surface (3*d*, 12*d*) includes recesses extending in a direction substantially from the nipple section (6*a*, 9*a*) to a circumference of the deflecting surface (3*d*, 12*d*). The bores (6*c*, 9*c*)
(Continued)

and deflecting surface (3*d*, 12*d*) have a mutual positioning so that straight liquid jets flowing through the bores (6*c*, 9*c*) will hit the deflecting surface (3*d*, 12*d*) with at least a bevel angle α.

7 Claims, 7 Drawing Sheets

(51) Int. Cl.

| | |
|---|---|
| ***A62C 37/00*** | (2006.01) |
| ***A62C 37/08*** | (2006.01) |
| ***A62C 31/05*** | (2006.01) |
| ***A62C 99/00*** | (2010.01) |
| *A62C 31/02* | (2006.01) |

(52) U.S. Cl.
CPC ..... *A62C 37/08* (2013.01); *A62C 37/11* (2013.01); *A62C 37/14* (2013.01)

(58) Field of Classification Search
USPC ..... 169/37, 41, 57, 58
See application file for complete search history.

(56) References Cited

U.S. PATENT DOCUMENTS

| | | | | |
|---|---|---|---|---|
| 7,578,454 | B2 * | 8/2009 | Joo | A62C 31/05 169/37 |
| 2004/0256118 | A1 | 12/2004 | Dunster et al. | |
| 2006/0185859 | A1 * | 8/2006 | Lin | 169/74 |
| 2011/0061879 | A1 * | 3/2011 | Lakkonen | A62C 31/05 169/37 |
| 2014/0367125 | A1 * | 12/2014 | Krager | A62C 37/14 169/37 |

OTHER PUBLICATIONS

International Preliminary Report on Patentability issued in International Application No. PCT/NO2010/000457 dated Jun. 19, 2012 (7 pages).

Supplementary Search Report in European application No. 10837943.9 dated May 12, 2016, 4 pages.

* cited by examiner

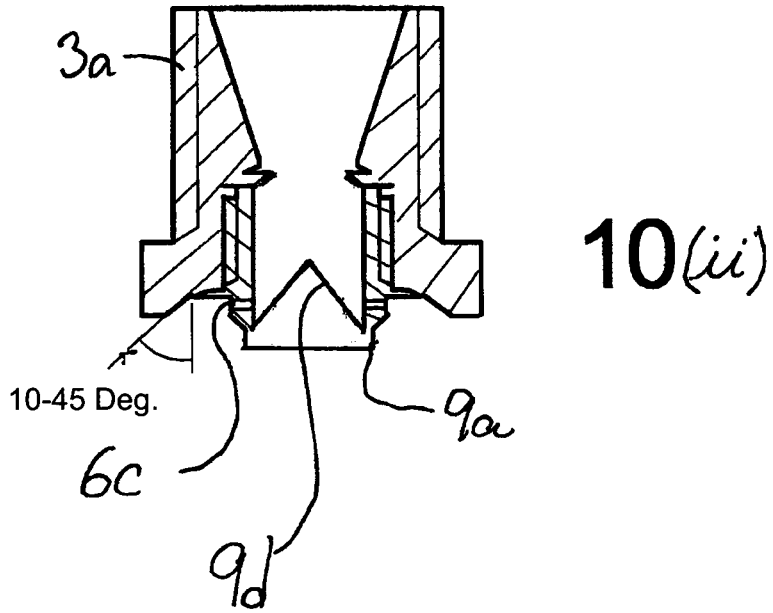
3a
10-45 Deg.
6c
9d
9a
10(ii)

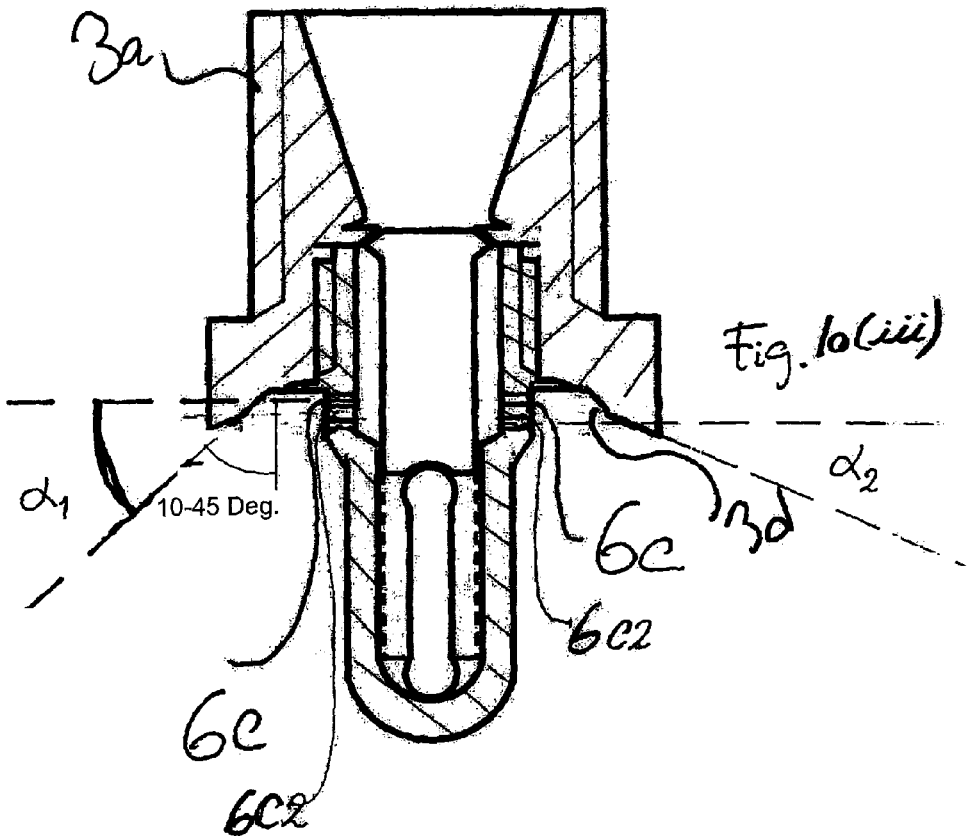
3a
Fig. 10(iii)
$\alpha_1$
10-45 Deg.
$\alpha_2$
3d
6c
6c2
6c
6c2

FIRE EXTINGUISHING ASSEMBLY FOR TRANSFORMING A LIQUID TO A LIQUID MIST

CROSS-REFERENCE TO RELATED PATENT APPLICATIONS

The present application is a National Stage Application of PCT/NO2010/000457, filed Dec. 14, 2010, and claims priority to Norway Application No. 20093514, filed Dec. 14, 2009, both applications of which are incorporated herein by reference in their entirety.

FIELD OF THE INVENTION

The present invention relates to a fire extinguishing assembly for putting out fire in installations and for transforming a liquid into a liquid mist.

BACKGROUND OF THE INVENTION

In many installations it is common to have more or less permanent piping with nozzles ejecting water or water mist. Examples of such installations include buildings, ships, offshore installations, tunnels, mines, or generally any facility or location at which it is desired to be able to put out or prevent fire. Sprinkler systems have been used in such installations for a long time.

In many situations, the use of water mist is preferable to sprinkler systems from which water is discharged in the form of larger drops, because water mist often provides for a more efficient fire-extinguishing, requires less water, causes less water damages, may be used in connection with fire in liquids and gases, and has a lesser negative impact on electric installations. Water mist systems may be used anywhere as a replacement for sprinkler systems. In connection with permanently installed fire extinguishing systems it is common for the fire-extinguishing assemblies to be under a certain water pressure. These characteristics are common for prior art sprinkler systems and fire extinguishing assemblies. Heat-sensitive glass bulbs are commonly used in permanently installed fire extinguishing systems.

However, water-based fire extinguishing assemblies suffer from certain associated disadvantages. Such assemblies are often manufactured with small nozzle openings which easily become clogged by contaminations in the water, and therefore normally a screening or water filtering system is required. Also, such assemblies typically have been relatively weighty, which is undesirable especially on vessels and floating structures as a large number of assemblies are required which combines to increase the overall weight significantly. Moreover, many of these assemblies also require a high inlet pressure in order to function properly, which increases the complexity, the necessary rating of the piping, the costs, as well as reduces the reliability particularly in case of fire. In addition, another problem is related to seals of known assemblies, and poor seals may result in leaks disrupting the mist pattern. Many assemblies also produce a relatively poor spreading of the mist, and a single generator, therefore, may only be used in rooms of a relatively limited size.

From NO 314835 an arrangement is disclosed for providing small water droplets, for use in particular for water-based fire-extinguishment. The arrangement is adapted for pivoting around its own axis, and is constituted by a hollow shaft. At least two circular water distribution disks are attached to the one end of the shaft by way of bolts. The water distribution disks are arranged in a spaced relation by means of spacers on the bolts. Each water distribution disk has an open center section, an inner horizontal annular surface, a steeply descending section, a less steeply descending section, as well as a narrow outer horizontal surface. A water supply conduit is provided in the hollow shaft. The conduit connects to a water supply at a one end and is closed and protrudes to the lowermost water distribution disk at the other end. The conduit comprises at least a water outlet at the levels in between two by two water distribution disks.

SUMMARY OF THE INVENTION

The present invention relates to a fire extinguishing assembly having relatively large flow-through openings, hence being less sensitive to water 15 contaminations. The invention also relates to an assembly which is able to operate within a wide range of pressures, and the large flow-through openings allows the assembly to operate even at relatively low pressure levels.

The entire pressure drop of the assembly occurs across entirely fixed holes, and consequently no dynamic seals are required, which could potentially cause leaks. The assembly may also be made very small and light, and may be adapted for dispersing the mist in different angles. Moreover, testing has shown that an assembly according to the invention will be able to protect a larger volume than the assemblies which are commonly used today.

Hence, the present invention relates to a fire extinguishing assembly for putting out fire in installations and for transforming a liquid into a liquid mist. A liquid, in this context, will in most cases be water, with or without additives.

The assembly includes an adapter section having a substantially circular cross-section and at least one liquid inlet which connects to an internal duct. Typically, the adapter section is provided with ordinary threads for being connected to a piping system for the supply of extinguishant, usually water, and will typically be made of materials commonly used for fittings, such as brass or stainless steel, for example. The adapter section has an internal duct or bore extending into a duct or bore of a nipple section. The nipple section includes a plurality of openings or bores extending through the nipple section from this duct and having outlets located substantially along a ring pattern in one or two planes around the nipple section. Typically, the bores/openings are circular, but could naturally be implemented with another shape. These bores form nozzles for discharging the liquid. The number of bores and the sizes thereof must be adapted for the desired flow-through rate, for the pressure range within which the assembly is intended to operate, etc. An assembly of this kind typically will operate with a discharge rate of 25 l/min and will cover an area in the order of 25 $m^2$ or more, for example.

A first, circular deflecting surface having an outer circumference for guiding the liquid is located in a position around the outlets of the bores.

The bores extend between the internal duct connected to the liquid inlet and outlets at an outside of the nipple section. The bores are positioned around the nipple section. The deflecting surface for guiding the liquid is positioned around the outlets of the bores.

The deflecting surface includes recesses running in a direction substantially from the nipple section to a circumference of the deflecting surface. The bores and deflecting surface have a mutual positioning so that straight liquid jets flowing through the bores will hit the deflecting surface with at least a bevel angle. The bores may be directed in different angles so that different bevel angles between the jet and deflecting surface may be formed on the very same assembly.

The deflecting surface may be annular and is constituted by a part of the adapter section. In one embodiment, the nipple section may be threaded into the adapter section in a center hole of the deflecting surface. In an embodiment in which the deflecting surface is a loose ring, this ring may be fastened to the adapter section with the nipple section. Typically, the deflecting surface will have the shape of an internally truncated cone opening towards the area to be exposed for the liquid mist, in a direction away from the adapter section and nipple section.

The distance between the outlets of the bores and the deflecting surface is typically between 3-15 mm.

The recesses of the deflecting surface may be designed so as to provide a component of movement in a tangential direction. The recesses then will typically have a tangential component so that these don't extend in a plane in a purely radial direction relative to a nipple having a circular cross-section. The recesses may also be curved.

The nipple section may have a circular cross-section, and jets of liquid flowing through the bores may pass in a plane in a radial direction out of the bores relative to the circular cross-section of the nipple section.

The nipple section may have a longitudinal axis and the bores may run in a bevel angle to the longitudinal axis of the nipple section.

The nipple section may include an internal guiding body in order to increase the velocity of the liquid towards the bores.

The assembly may include a valve having a valve body. The valve body may include a valve spindle contacting a heat sensitive actuator element, and the valve body may assume a first position in which the inlet is sealed off, and a second position in which the inlet is in fluid communication with the bores. The heat sensitive actuator element may be an ordinary frangible element commonly used in connection with sprinkler systems, or may be based on electronic sensing, electrical actuators, remote control, etc. This is well-known technology within this field.

The bores may be provided in at least one ring around the nipple section, and the outlets on the outside of the nipple section may be adjusted so that every second liquid jet hit a point at a first distance from the deflecting surface and the remaining liquid jets hit a point at a second distance from the deflecting surface, with the first distance being different from the second distance.

The first and second distances may be adjusted by varying an angle of discharge.

The first and second distances may be adjusted in that every second outlet is positioned along a first ring around the nipple and the remaining outlets are positioned along a second ring around the nipple, with the first and second rings being located at a distance from each other.

The deflecting surface may be designed with two different angles so that every second liquid jet hit the surface at the first angle and the remaining liquid jets hit the surface at the second angle in order to provide a liquid mist screen having a larger volume.

BRIEF DESCRIPTION OF THE DRAWINGS

FIG. 2 shows a screen;

FIG. 3 shows an adapter;

FIG. 4 shows a valve body;

FIG. 5 shows a glass bulb;

FIG. 6 shows a nipple having a glass bulb fastening clamp;

FIG. 7 shows a plastic cover;

FIG. 10(*i*) corresponds to FIG. 10, but shows more clearly an angle between a nozzle and a deflecting body;

FIG. 10(*ii*) exhibits features similar to FIG. 10, but shows an alternative embodiment not having thermal release;

FIG. 10(*iii*) exhibits features similar to FIG. 10, but shows an alternative embodiment having an angled deflecting surface;

FIG. 12(*i*) shows a detail of FIG. 12 illustrating serrations or grooves;

The present invention will now be described in more detail with reference to the accompanying drawings.

DETAILED DESCRIPTION OF THE INVENTION

Figure 1:
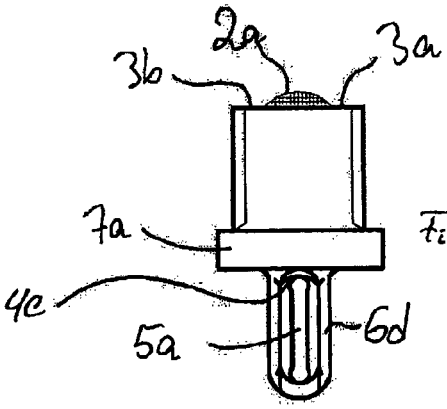
FIG. 1 shows a side view of an assembled fire extinguishing assembly having thermal release according to the invention.

Referring to FIG. 1, a fire extinguishing assembly in the form of an assembled fire extinguishing assembly having thermal release according to the invention is illustrated. The fire extinguishing assembly is made up of the components shown in FIGS. 2-7 in the order shown in the drawings. Hence, the fire extinguishing assembly is made up of a screen 2*a* positioned into an adapter 3*a* in an inlet 3*b* of the adapter 3*a*. Further, the assembly is shown having a fastening clamp 6*d* for a glass bulb 5*a*. The glass bulb contacts a section 4*c* constituting part of a valve body. A plastic cover 7*a* is positioned around the adapter 3*a*.

A tightening screw (not shown) presses a valve element against a valve seat via the bulb. When the heat-sensing bulb 5*a* is broken, the valve element inside the fire extinguishing assembly is allowed to move between a closed and an open position. The cover 7*a* is extorted from and falls off the assembly when the extinguishant is activated after the bulb has been broken and water flows through the assembly.

Figure 2:
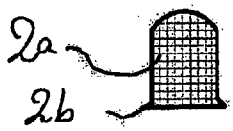
FIGS. 2-7 show the individual components of which the fire extinguishing assembly of FIG. 1 is comprised.

In FIG. 2, the screen 2*a* is shown in more detail. The screen 2*a* includes a lower edge 2*b* retaining the screen within the adapter after installation. The screen 2*a* prevents impurities from clogging nozzle openings of the assembly.

Figure 3:
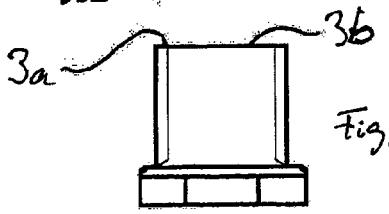

In FIG. 3, adapter 3*a* is shown. Adapter 3*a* includes an inlet 3*b* that typically includes an internal thread for connecting the assembly to a piping system.

Figure 4:
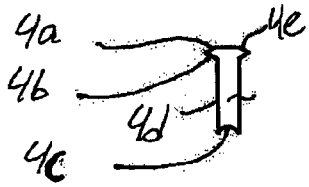

FIG. 4 shows a moveable valve body 4*a* having sealing surfaces for sealing against valve seats of the adaptor 3*a*. A first sealing surface 4*e* provides for sealing against a valve seat of the adapter 3*a* so that no water flows out of the assembly when the assembly is not in operation. A second sealing surface 4*b* seals against the valve seat of the adapter 3*a*, making sure no extinguishant leaks out of the assembly so that all the liquid flows out the nozzles, bores or openings 6*c* of nipple 6*a*. The first sealing surface 4*e* is tapered and also serves to guide the liquid towards the nozzles when the valve is in an open position. The first sealing surface 4*e* hence serves two purposes. The valve body 4*a* further includes a valve mandrel or valve spindle 4*d* having an engagement section 4*c* for engaging the glass bulb (5*a* of FIG. 1).

A plastic cover 7*a* is mounted on top of the assembly to improve the appearance of the assembly, as well as to help prevent the assembly from being affected by any dirt or other undesired substances which could influence the function of the assembly.

Figure 5:
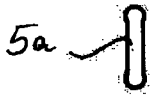

FIG. 5 shows a heat-sensitive glass bulb 5*a* commonly used in sprinkler systems and other installations that is supposed to break at a given temperature. The glass bulb 5*a* is located between section 4*c* for engaging a glass bulb on valve spindle 4*d* and the fastening clamp 6*d* of nipple 6*a*.

Figure 6:
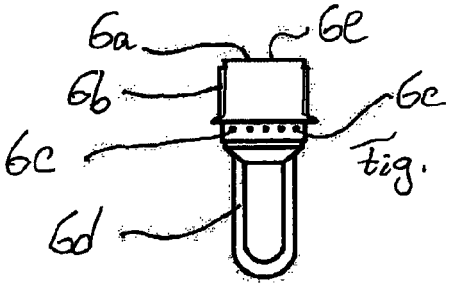
Figure 7:
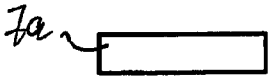

FIG. 6 shows the nipple 6*a* with the glass bulb fastening clamp 6*d*. Nipple 6*a* includes a threaded section 6*b* which may be screwed into threads of the adapter 3*a*. The nozzle openings or holes 6*c* are positioned in a ring around the nipple 6*a*. In operation, extinguishant flows in through nipple inlet 6*e* and out through nozzle openings 6*c*. The clamp 6*d* keeps the glass bulb 5*a* in place between this and the valve 4*a* having engagement section 4*c* (FIG. 1).

A plastic cover 7*a* is provided on top of the assembly for making the appearance more appealing. In addition, the cover may also prevent fouling of the assembly and of a deflecting surface. A hole (not shown) for the clamp 6*d* for the heat-sensitive bulb may be formed in the cover 7*a*. Typically, the cover is made of plastic.

Figure 8:
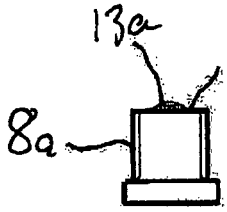
FIG. 8 shows a side view of an assembled fire extinguishing assembly not having thermal release according to the invention.
Figure 15:
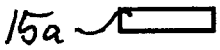
FIG. 15 shows a plastic cover similar to the one shown in FIG. 7.

An embodiment of a fire extinguishing assembly in the form of a fully assembled assembly without thermal release according to the invention is shown in FIG. 8. In this embodiment, a nipple 9*a* (shown in FIG. 9) is used which does not include any glass bulb clamp. Also, in this embodiment, it is not necessary to have a valve body inside the assembly. Nipple 9*a* hence has a somewhat simpler construction than the nipple of the solution with thermal release, as the valve, glass bulb and clamp are not eliminated. Also in this embodiment a screen 13*a* (FIG. 13) is shown. For example, in this embodiment, the water supply may be controlled centrally and be released in an otherwise known manner. If it is known for sure that the water is sufficiently free of impurities, then also screen 13*a* may be eliminated. Alternatively, larger central filtering units may be used. This solution also includes a protective cover 15*a* (FIG. 15) which is extorted when pressure is applied to the assembly.

Figure 13:
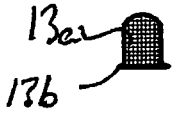
FIG. 13 shows a screen similar to the one shown in FIG. 2.

FIG. 13 shows a detailed view of the screen 13*ba*. The screen 13*a* includes a lower edge 13*b*. The screen may have the same design and function as the screen shown in FIG. 2.

Figure 14:
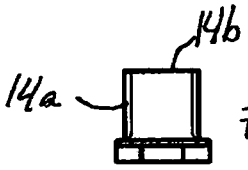
FIG. 14 shows an adapter similar to the one shown in FIG. 3.

FIG. 14 shows the adapter 14*a*. The adapter 14*a* includes an inlet 14*b*. The adapter may have the same design and function as the adapter shown in FIG. 3.

Figure 9:
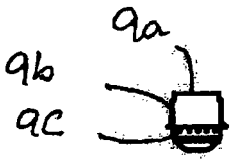
FIG. 9 shows a nipple a nipple not including a glass bulb fastening clamp.

In FIG. 9 can be seen a nipple 9*a* having no glass bulb fastening clamp. Nipple 9*a* includes a threaded section 9*b* which may be screwed into mating threads of the adapter 9*a*. Nozzle openings or holes 9*c* are positioned in a ring around the nipple 9*a*. In operation, extinguishant flows in through an opening 9*e* and is discharged through nozzle openings 9*c*. In this embodiment, the assembly has a lesser outward extent, it is easier to manufacture an assembly having a plastic cover covering the assembly, and it is easier to conceal the assembly.

To give the assembly a more appealing appearance, a plastic cover 15*a* has been placed on top of the assembly. The cover may also prevent fouling of the assembly as well as of a deflecting surface.

Figure 10:
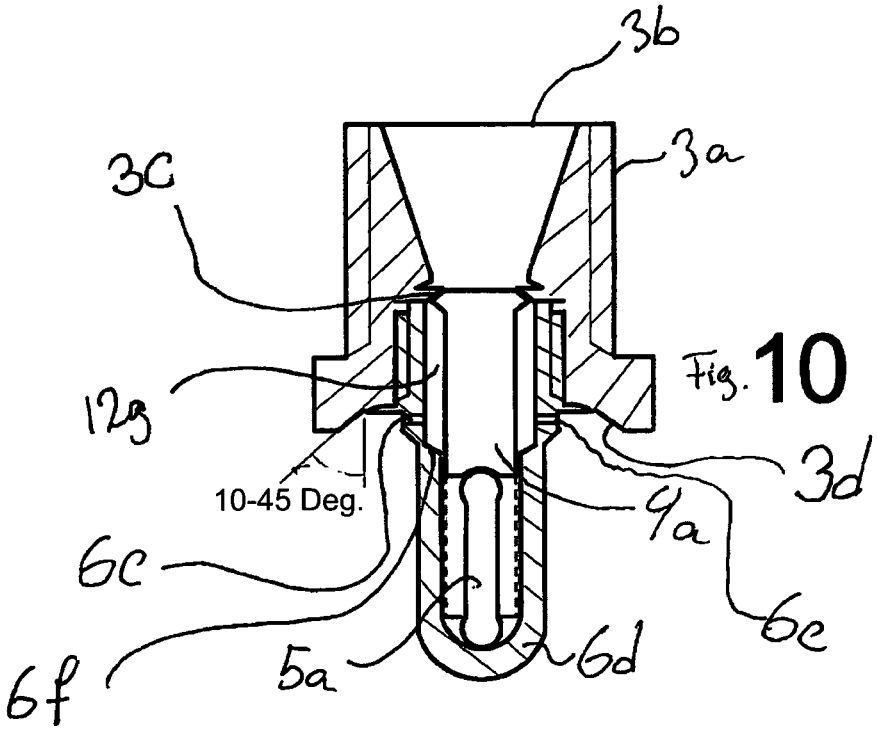
FIG. 10 shows a cut-through side view of an assembled fire extinguishing assembly having thermal release according to the invention as shown in FIG. 1, in which the components of the assembly can be seen.
Figure 10I:
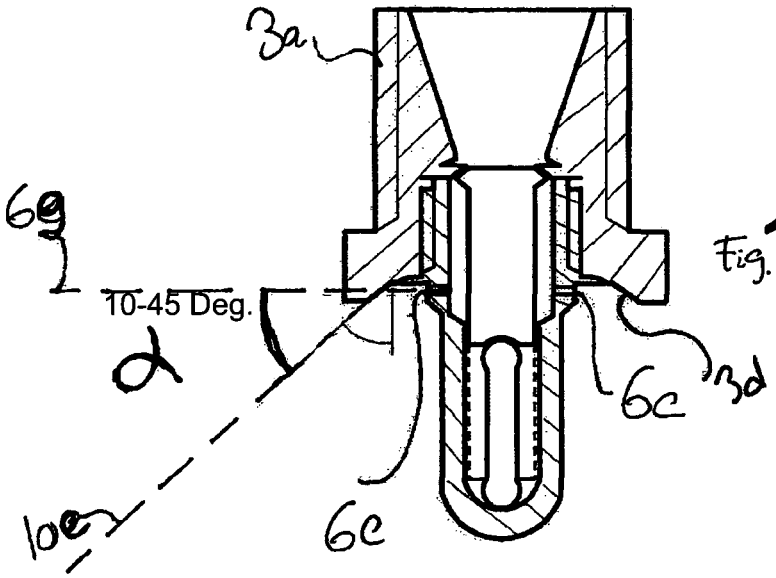

FIGS. 10 and 10*i* show the assembly of FIG. 1 in a cut-through side view so that the internal configuration of the assembly and the various elements therein can be seen.

FIG. 10 hence shows the adapter 3*a* with the extinguishant inlet 3*b*. Nipple 6*a* has been screwed into the adapter 3*a*. The internal valve is shown in a closed position. The adapter 3*a* is also shown to include a valve seat 3*c*, against which the valve body 4*a* is pressed by the glass bulb 5*a*. The glass bulb is kept in place by fastening clamp 6*d*. In FIG. 10, the assembly is shown with the valve in a closed position and with the glass bulb 5*a* in place so as to maintain the valve body 4*a* engaged with the valve seat 3*c*. If the glass bulb 5*a* is heated to the point of rupture, the valve body 4*a* is forced downwards and will abut against a valve seat 6*f* of the nipple, so that the valve seat forms a seal against the second sealing surface 4*b* of the valve body to prevent leakage so that all the extinguishant is discharged through the nozzle opening 6*c*. The lower position of the valve seat has been indicated with a dotted line down into fastening clamp 6*d*. In operation, the liquid will be sprayed out of the nozzle opening 6*c* and will be deflected by the deflecting surface 3*d* of the adapter 3*a*. The valve spindle descends towards the clamp for the heat-sensing bulb when the valve is in the open position 14.

FIG. 10(*i*) corresponds to FIG. 10, but shows more clearly an angle $\alpha$ between a liquid jet flowing out of nozzle 6*c*. A dotted line 6*g* runs through the nozzle 6*c* to indicate a direction of the liquid jet. A second dotted line 10*e* is shown along the deflecting surface 3*d* (in a radial direction). Thus, the angle $\alpha$ between these lines corresponds to the angle between the liquid jet discharged through the nozzles and the deflecting surface, and hence also the angle with which the jet hits the deflecting surface 3*d*. The angle $\alpha$ is between 10° and 45°.

The angle may vary between 20° and 35°.

The angle $\alpha$ may be varied in order to vary the dispersion and distribution of the liquid. The angle also has an impact on the atomization of the liquid.

FIG. 10(*ii*) exhibits features similar to FIG. 10, but shows an alternative embodiment not having thermal release. FIG. 10(*ii*) has been included in order to show an internal guiding body 9*d* for increasing the velocity of the liquid towards the nozzles 6*c*. In the solution including a valve, such as the one shown in FIG. 10, for example, the valve body will serve as an internal guiding body. In the solutions not including a valve, and as shown in FIG. 10(*ii*), this body may be integrated into the nipple 9*a*. The guiding body 9*d* may also be constituted by a loose part introduced into the assembly. In the embodiment shown, the body is shaped as a taper or cone. However, the guiding body 9*d* may assume other shapes, in that the taper has a rounded top, for example. The body 9*d* may also have the shape of a trumpet or funnel having a downward facing opening. Other shapes contributing to guide the water from the inlet and out of the nozzles may also be used.

FIG. 10(*iii*) shows an alternative embodiment having an angled deflecting surface 3*d* for which a liquid jet from outlet 6*c* directed along a first ring around the nipple hits a first section of the deflecting surface with an angle α1 and a liquid jet from outlet 6*c*2 directed along a second ring around the nipple hits a second section of the deflecting surface with an angle α2. In the embodiment shown, the first angle α1 is larger than the second angle α2. In order to simplify the illustration, outlets 6*c* and 6*c*2 are shown positioned directly above each other. However, in the normal case, such outlets will be radially offset relative to each other and will run along separate rings around the adapter, with every second outlet running along an upper and lower ring, respectively, in a staggered pattern.

Figure 11:
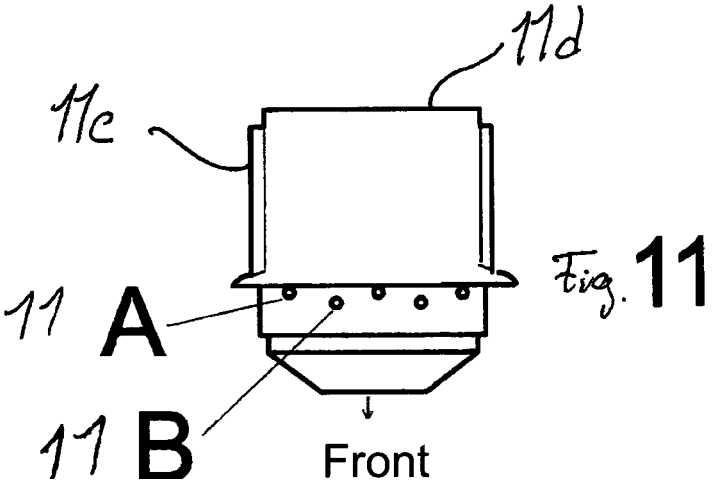
FIG. 11 shows a nipple as shown in FIG. 9 in more detail.

In FIG. 11, a nipple having an external thread 11*c* and an inlet 11*d* is illustrated. FIG. 11 also shows that the holes 11A and 11B of the nipple are offset relative to each other. The advantage of having holes in an offset configuration is that the points of impingement of the liquid jets on the deflecting surface may then be varied so that the area of the deflecting surface are more fully exploited. The reason for this is that tests have shown that each jet of liquid needs a certain area on the deflecting surface in order to be transformed into a mist with no too large liquid drops being formed. Large liquid drops are typically formed when liquids from two jets/liquid screens collide, and this is undesirable when the intention is to create a mist. When the angle of the nozzle is increased, the axial velocity of the water also increases. Nozzles with a zero angle maximize the velocity of the water in a radial direction.

This variation in the point of impingement between the jets and deflecting surface may also be achieved by creating different angled nozzles.

Figure 12:
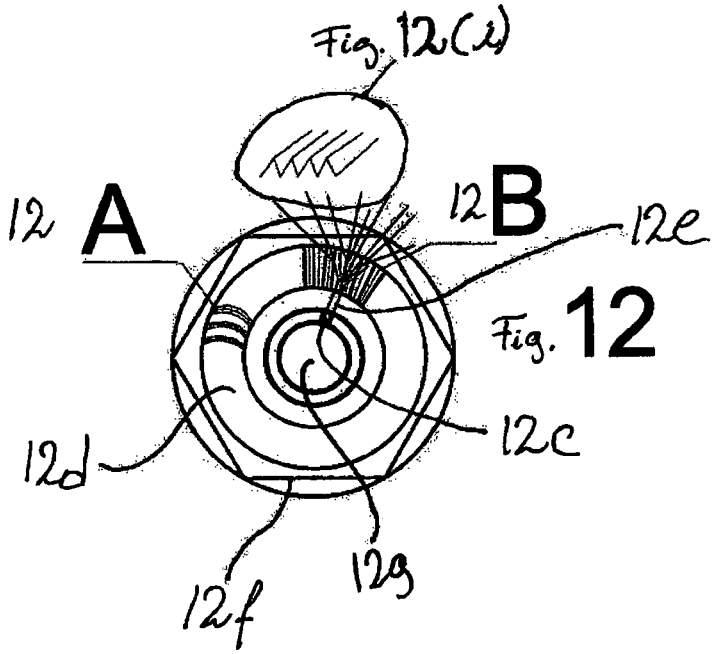
FIG. 12 shows an assembled fire extinguishing assembly not having thermal release according to the invention, as seen in a front view.

FIG. 12 shows a front view of an assembly according to the invention wherein the nipple has been partially cut-through in order to illustrate a nozzle opening 12*c*. A duct 12*g* extends in the center of the assembly. Liquid flowing from the duct 12) and out nozzle 12*c* forms a liquid jet 12*e*. The liquid jet hits recesses provided in a deflecting surface 12*d* to become deflected and atomized so that preferably a liquid mist is formed. For example, the recesses may be shaped as grooves, ripples, or serrations. The recesses may be curved grooves 12A or straight grooves 12B. Typically, the recesses will be slightly curved or angled in order to help guiding, dispersing, and atomizing the liquid. The purpose of the recesses is to tear up the liquid so that this liquid is atomized to form a liquid mist. The assembly may be designed with en external edge 12*f* for being engaged by a tool, typically a hexagonal edge.

FIG. 12(*i*) shows a detail of the recesses. For example, these recesses may be shaped as teeth in a cog wheel, be saw-toothed or serrated.

In the embodiments illustrated, the adapter is shown threaded into the nipple. Alternatively, these two elements could have been made in one piece. The deflecting surface may also be constituted by a separate part that may be replaced, and each assembly may be adapted, for example, for deflecting surfaces having different angles or surface structure. Typically, the deflecting surface may be produced as a separate serrated ring. The embodiments shown have been found to be easily producible as well as cost efficient, while at the same time being flexible and possible to deliver with or without thermal release.

Normally, the deflecting surface is substantially circular. In this connection, substantially circular also includes oblong or oval, for example, and such shapes may be relevant for use in oblong rooms, for example, as the water throwing length may vary in different directions. Normally, the deflecting surface runs around the entire nipple.

In normal operation of the arrangement, extinguishant flows through the liquid inlet of the adapter section, through the internal duct that connects to the liquid inlet, and out through openings provided around the nipple section. From these openings, the jet of extinguishant flows freely to the deflecting surface, which it hits with the angle α and is atomized to a water mist in the form of small droplets. The angle is dictated by the angle of the openings determining the angle of the jet relative to the angle of the deflecting surface, as explained above. The serrations or grooves may have deep to shallow grooves with varying directional angles for the grooves as shown in FIG. 12(*i*).

In the above description the fire extinguishing assembly has been described in connection with a permanent installation. Of course, however, an assembly according to the invention may be used for portable equipment, and is very well adapted for such use as the invention is light and compact. For example, the fire extinguishing assembly may be used in small vehicles or lances being entered into a fire zone or on a spear which is run through walls/roofs/floors of a room being in fire.

The present fire extinguishing assembly has been described in connection with the extinguishment of fire. Of course, however, the assembly may also be used in places at which a need exists for a water mist or dispersion of water, such as in connection with moistening of air, for different purposes in green houses, storage of timber to be kept in a moist condition, etc.

The invention claimed is:

1. A fire extinguishing assembly for transforming a liquid into a liquid mist, the assembly comprising:

an adapter section having at least one liquid inlet; and a nipple section fixedly in connection with the adapter section, the nipple section comprising:

multiple bores extending between an internal duct that connects to the liquid inlet and outlets on an outside of the nipple section, with the bores being positioned radially around the nipple section to direct the liquid radially outward from the nipple section, a deflecting surface for guiding the liquid is positioned around the outlets of the bores; wherein the deflecting surface includes recesses in the form of grooves, ripples or serrations running in a direction from the nipple section to a circumference of the deflecting surface; and the bores and deflecting surface have a mutual positioning so that straight liquid jets flowing through the bores will directly hit the recesses of the deflecting surface in a point of impingement having at least a bevel angle to produce a fine mist.

2. The fire extinguishing assembly of claim 1, wherein the recesses of the deflecting surface are shaped in order to provide a component of movement in a tangential direction.

3. The fire extinguishing assembly of claim 1, wherein the recesses extend with a component tangential to a circumference of the nipple.

4. The fire extinguishing assembly of claim 1, the bores being positioned in at least one ring around the nipple section, and wherein the outlets on the outside of the nipple section are adjusted so that every second liquid jet hits the recesses at a point at a first distance from the deflecting surface and the remaining liquid jets hit the recesses at a point at a second distance from the deflecting surface, with the first distance being different from the second distance.

5. The fire extinguishing assembly of claim 4, wherein the first and second distances are adjusted by varying an outlet angle.

6. The fire extinguishing assembly of claim 4, wherein the first and second distances are adjusted in that every second outlet is positioned along a first ring around the nipple and the remaining outlets are positioned along a second ring around the nipple, with the first and second rings being located in a spaced relation from each other.

7. The fire extinguishing assembly of claim 4, wherein the deflecting surface is designed with a first angle and a second angle so that every second liquid jet hits the surface of the recesses at the first angle and the remaining liquid jets hit the surface of the recesses at the second angle in order to provide a larger volume liquid mist screen.

* * * * *